US005365161A

United States Patent [19]

Inoue et al.

[11] Patent Number: 5,365,161

[45] Date of Patent: Nov. 15, 1994

[54] STABILIZED VOLTAGE SUPPLY

[75] Inventors: Koichi Inoue; Takahiro Ota, both of Kyoto, Japan

[73] Assignee: Rohm Co., Ltd., Kyoto, Japan

[21] Appl. No.: 980,725

[22] Filed: Nov. 24, 1992

[30] Foreign Application Priority Data

Nov. 26, 1991 [JP] Japan ..... 3-336048

[51] Int. Cl.[5] ..... G05F 1/565

[52] U.S. Cl. ..... 323/282; 323/234; 323/284; 363/74

[58] Field of Search ..... 323/234–265, 323/282, 284–901, 312; 363/74–78

[56] References Cited

U.S. PATENT DOCUMENTS

| | | | |
|---|---|---|---|
| 4,470,020 | 9/1984 | Mohr | 330/304 |
| 4,731,574 | 3/1988 | Melbert | 323/282 X |
| 4,760,434 | 7/1988 | Tsuzuki et al. | 323/284 X |
| 4,810,847 | 3/1989 | Ito | 323/901 X |
| 4,929,883 | 5/1990 | Chieli | 323/282 |
| 4,964,010 | 10/1990 | Miyasaka et al. | 361/18 |
| 5,079,497 | 1/1992 | Barbu et al. | 323/303 X |
| 5,177,431 | 1/1993 | Smith et al. | 323/349 |

*Primary Examiner*—Steven L. Stephan
*Assistant Examiner*—Adolf Berhane

[57] ABSTRACT

A stabilized voltage supply has a semiconductor and an output transistor formed on the semiconductor substrate and responsive to a power voltage. When the power voltage decreases to a level equal to or lower than a predetermined level, the output transistor is saturated. At this time, the semiconductor substrate is heated. The stabilized voltage supply also has a voltage dividing resistor for converting the output current of the output transistor into a stabilized output voltage which in turn is divided to form a feedback voltage. The stabilized voltage supply further has a differential amplifier for amplifying a differential voltage between the feedback voltage and a predetermined reference voltage, the differential voltage being then applied to the control electrode of the output transistor. The control electrode of the output transistor receives a current corresponding to the current applied thereto. The stabilized voltage supply further has a voltage detecting circuit for detecting when the power voltage decreases to a level equal to or lower than the predetermined level, and a current feedback circuit for dividing the output current of the output transistor and for subtracting a current corresponding to the divided current from the current at the control electrode of the output transistor when the power voltage decreases to a level equal to or lower than the predetermined level.

13 Claims, 5 Drawing Sheets

STABILIZED VOLTAGE SUPPLY

BACKGROUND OF THE INVENTION

1. Field of the Invention

The present invention relates to a power supply including amplifier means for amplifying a reference voltage and for outputting the amplified voltage and particularly to a stabilized voltage supply usable with multi-source IC and the like.

2. Description of the Related Art

CD players require a high-accuracy servo control for the pickup. For example, the tracking servo control or pickup focus servo circuit must have a particularly high accuracy in control. A power supply for supplying a power voltage to such high-accuracy servo control circuits (but not limited to those of the CD players) is required to have extremely small fluctuations in the output voltage. Therefore, such a type of power supply should be formed so as to provide a stabilized output voltage, that is, a so-called stabilized voltage supply.

FIG. 5 shows the principle of such a power supply. A circuit generally shown by 6 in FIG. 5 comprises a differential amplifier 2 and an output transistor 4. The noninverting input terminal of the differential amplifier 2 receives a DC voltage $V_{ref}$ from a constant voltage source 8, with the inverting input terminal thereof receiving a DC voltage $V_n$ from a bleeder network resistance comprising resistors 10 and 12. The differential amplifier 2 compares the voltage from the noninverting input terminal with the voltage from the inverting input terminal to form a differential voltage which in turn is amplified and outputted by the differential amplifier 2. The output transistor 4 has an emitter connected to a power line 15. Thus, the output transistor 4 will receive a power voltage Vcc through a power terminal 14 and the power line 15. The collector of the output transistor 4 is grounded through the resistors 10 and 12.

The resistors 10 and 12 define a bleeder network resistance for feeding the collector current of the output transistor 4 back to the differential amplifier 2 in the form of voltage. More particularly, when the collector current of the output transistor 4 flows in the resistors 10 and 12, a DC voltage is produced between the opposite ends of the series connection of the resistors 10 and 12 (current/voltage conversion). This DC voltage is divided by a particular ratio of resistance therebetween to produce the DC voltage $V_n$ (voltage division). Since the value of the DC voltage corresponds to the value of the collector current, the output voltage of the differential amplifier 2 will correspond to a difference between the value of the collector current and a predetermined value when the DC voltage $V_n$ is applied to the inverting input terminal of the differential amplifier 2 through a feedback line 16 (feedback control of the differential amplifier 2).

The output end of the differential amplifier 2 is connected to the base of the output transistor 4. Therefore, the current taken from the base of the output transistor 4 to the output end of the differential amplifier 2, that is, the value of the base current of the output transistor 4 will be determined depending on the output voltage of the differential amplifier 2. The collector current of the transistor 4 will be determinded by the base current thereof. A voltage $V_0$ at the collector of the output transistor 4 can be taken from the output terminal 18 as a stabilized output since the collector current of the output transistor 4 is fed back to the differential amplifier 2 in the form of voltage feedback manner, as described.

The stabilizing circuit 6 may be formed as a semiconductor integrated circuit. FIG. 6 shows an example of the output transistor 4 which is formed on a P substrate 20.

The output transistor 4 comprises an N base domain 24, a P+ emitter domain 30 and a P+ collector domain 32. The output transistor 4 is surrounded by an isolation domain 26 for separating the output transistor 4 from the other circuit components. The isolation domain 26 may be a P+ domain formed, for example, by the epitaxial growth or the like. An N+ implanted layer 22 is formed below the N domain 24 such as by the ion implantation. An N+ domain 28 is a base contact domain.

When the power voltage $V_{cc}$ approaches the stabilized output $V_0$ in the stabilizing circuit 6 as shown in FIG. 5, the output transistor 4 transfers to its saturated state. If the power voltage $V_{cc}$ is supplied to the system from a battery, a state where the power voltage $V_{cc}$ approaches the stabilized output $V_0$, that is, a power reduction state is created on discharge of the battery. The power reduction state is also produced by rapid change in the external load. As the output transistor 4 transfers to its saturated state, a saturation current flows therein. This renders the provision of a preferred stabilized output $V_0$ difficult.

The fact that the power voltage $V_{cc}$ approaches the stabilized output $V_0$ means that in the arrangement of FIG. 6, the difference between the potentials of the emitter and collector domains 30, 32 decreases. If it is now assumed that a parasitic transistor 34 is used, having the P+ domain 30 as an emitter, the N domain 24 as a base and the isolation domain 26 as a collector, this transistor 34 will be turned on when the potential of the P+ domain 30 approaches that of the P+ domain 32 to decrease the difference therebetween. The collector current of the parasitic transistor 34, that is, the rush current that flows from the P+ domain 30 to the isolation domain 26 and thus toward the substrate 20, is determined depending on the scale of the P+ domain 30. The P+ domain 30 defines the emitter domain of the output transistor 4. Thus, the scale of the P+ domain 30 (i.e. the cross-sectional domain perpendicular to the direction of current in the emitter domain 30) is designed depending on the output current required in the output transistor 4. Normally, the scale of the P+ domain is relatively large since the current required in the output transistor 4 is relatively large. This means that the rush current from the parasitic transistor 34 to the substrate 20 is also increased.

When the transistor 4 transfers to its saturated state by the power reduction as described, the substrate 20 is heated by the saturated and rush currents to disturb the stabilized potential of the substrate 20. This impairs the operation of the stabilizing circuit 6.

In order to overcome such a disadvantage, it is preferred to arrange the circuit as shown in FIG. 7. In the arrangement of FIG. 7, a saturation preventing circuit 36 for preventing the stabilizing circuit 6 from transferring to its saturated state is located upstream of the stabilizing circuit 6. The saturation preventing circuit 36 comprises a differential amplifier 38, a transistor 40 and resistors 42, 44 and 46. The noninverting input terminal of the differential amplifier 38 receives the reference voltage $V_{ref}$ from a source of voltage 48, with the inverting input terminal thereof being adapted to receive the reference voltage $V_p$ from the connection P between resistors 44 and 46. The reference voltage $V_p$ is applied to the noninverting input terminal of the differential amplifier 2 in the stabilized circuit 6 so as to be used as the reference voltage in the stabilized circuit 6.

In the power supply, the resistances $R_1'$, $R_2'$, $R_1$ and $R_2$ of the respective resistors 10, 12, 44 and 46 are selected such that the following relationship is achieved therebetween:

$$R_1:R_2=R_1':R_2'.$$

The resistor 42 functions to saturate the transistor 40 having less influence from the parasitic transistor prior to the saturation of the output transistor 4. As the output transistor 40 transfers to its saturated state, the reference voltage $V_p$ will have a value equal to the voltage $V_n-(V_{ref}\times R\alpha/R_2)$ ($R\alpha$:the resistance of the resistor 42). In the power reduction state, thus, the transistor 40 transfers to its saturated state prior to the saturation of the output transistor 4. As a result, the output transistor is prevented from being saturated. Further, since the transistor 40 requires only a small output current, the current flowing toward the substrate 20 on saturation of the transistor 40 can be sufficiently reduced, compared with the saturation of the output transistor 4.

On stabilization, the output voltage $V_0$ taken into the output terminal 18 becomes:

$$V_0=V_{ref}\times(R_1+R_2)/R_2 \quad (1)$$

In such a power supply, however, the rush current created on transfer of the transistor 40 to its saturated state is varied due to variability in manufacture or the like. Thus, the current consumed in the power supply will vary from one product to another. Fluctuations in the saturation voltage of the transistor 40 are reflected to the output voltage $V_0$ as the reference voltage $V_p$. As a result, the stabilization will be impaired.

SUMMARY OF THE INVENTION

It is therefore an object of the present invention to prevent the output transistor from being saturated without need of any transistor to be saturated prior to the saturation of the output transistor.

To this end, the present invention comprises:

a) an output element for outputting a current having a value depending on a current to be supplied, the output element being responsive to a power voltage and adapted to be saturated and heated when the power voltage is lowered to a level equal to or lower than a predetermined level;

b) current/voltage converting means for converting the output current of the output element into a voltage which in turn is outputted as a stabilized output voltage;

c) means for comparing the stabilized output voltage directly or indirectly with a reference voltage, the comparing means being responsive to the result for supplying a current to the output element; and d) means for adjusting the current supplied to the output element so that the output element will not be saturated when the power voltage is lowered to a level equal to or lower than the predetermined level.

It is first assumed that the power voltage is not lowered to a level equal to or lower than the predetermined level. In accordance with the present invention, the voltage obtained by the current/voltage converting means is outputted as a stabilized output voltage while at the same time the stabilized output voltage is directly or indirectly compared with the predetermined reference voltage by the comparing means. The comparing means is responsive to the result of comparison to supply the current to the output element which in turn outputs a current having a value depending on the supplied current.

It is second considered that the power voltage is lowered to a level equal to or lower than the predetermined level. In accordance with the present invention, the current supplied to the output element is adjusted to prevent the output element from being saturated. At this time, any operation relating to the occurrence of the stabilized output is also executed.

In such a manner, the output element (e.g. output transistor) can be prevented from being saturated without need of any element saturated prior to the saturation of the output element.

In another aspect of the present invention, it comprises:

a) a semiconductor substrate;

b) an output transistor for outputting a current depending on a current at the control electrode of the output transistor, the output transistor being supplied with the power voltage, the semiconductor substrate being heated when the output transistor is saturated;

c) a voltage dividing resistor for converting the output current of the output transistor into a voltage which will be outputted as a stabilized output voltage, the stabilized output voltage being divided to form a feedback voltage to be outputted;

d) a differential amplifier for amplifying the feedback voltage by a difference between the feedback voltage and the predetermined reference voltage, the amplified voltage being then applied to the control electrode of the output transistor; and e) a circuit for preventing the output transistor from being saturated, this circuit comprising:

e1) a voltage detecting circuit for detecting when the power voltage is lowered to a level equal to or lower than a predetermined level; and e2) a current feedback circuit for dividing the output current of the output transistor to form a divided current when it is detected that the power voltage is lowered to a level equal to or lower than the predetermined level and for subtracting a current corresponding to the divided current from a current which is produced by the voltage of the output transistor and flows in the control electrode of the output transistor.

In such an arrangement, the current/voltage converting means is formed by the voltage dividing resistor. The voltage dividing resistor may comprise a resistor or resistors in which the output current of the output element (e.g. output transistor) flows. The resistor converts the output current of the output element into the stabilized output voltage while producing the feedback voltage divided from the stabilized output voltage. The voltage division may be performed by any known means such that a potential is taken out of a connection between resistors.

In the above arrangement, the comparing means is in the form of a differential amplifier. The differential amplifier compares the feedback voltage with a predetermined reference voltage which is produced by, for instance, a battery. The feedback voltage, which is to be compared with the predetermined voltage, is representative of the stabilized output voltage. From this fact, it is understood that the stabilized output voltage may be used directly as a feedback voltage. The differential amplifier outputs a voltage depending on the differential voltage between the inputted voltages.

The saturation preventing circuit comprises a voltage detecting circuit and a current feedback circuit. The current feedback circuit may include a current dividing means and a subtracting means. The current dividing means divides part of the output current of the output element when the power voltage is lowered to a level equal to or lower than the predetermined level. The subtracting means subtracts a current corresponding to the current level obtained by the current division from the current supplied to the output element. Such a circuit can be relatively simply formed by the following arrangement:

The voltage detecting circuit may comprise a voltage drop detecting resistor for detecting any reduction in the power voltage. The voltage drop detecting resistor receives a constant current from a source. By supplying the voltage drop detecting resistor with the constant current, the output voltage of the output element when the power voltage is lowered to a level equal to or lower than the predetermined level can be set based on the voltage drop in the voltage drop detecting resistor.

The source of constant current may comprise a voltage feedback resistor, a differential amplifier and a current control means. The voltage feedback resistor has the same value as that of the voltage drop detecting resistor and is connected in series to the voltage drop detecting resistor. The differential amplifier compares the voltage between the opposite ends of the voltage feedback resistor with a predetermined value to output a voltage corresponding to the resulting differential voltage. The current control means is responsive to the output voltage of the differential amplifier to control the current supplied to the voltage drop detecting resistor such that it becomes the constant current. The current control means may be formed using a transistor.

The source of constant current may be defined by a voltage feedback resistor and a current mirror circuit. The voltage feedback resistor has the same value as that of the voltage drop detecting resistor and is connected in series to the voltage drop detecting resistor. A transistor at the input of the current mirror circuit receives an external constant current. Another transistor on the output side of the current mirror circuit applies a current to the voltage drop detecting resistor. If the output side transistor has a current capacity larger than that of the input side transistor and when the output side transistor receives the voltage feedback from the voltage feedback resistor, the current supplied to the voltage drop detecting resistor can be controlled into the constant current.

The current dividing means may be in the form of a transistor which is energized to take part of the output current of the output element when the power voltage is lowered to a level equal to or lower than the predetermined level. The subtracting means may comprise a current mirror circuit for dividing a current corresponding to the current obtained by the current division from the current supplied from the comparing means to the output element.

In such a manner, the present invention can be realized by a relatively simple structure.

BRIEF DESCRIPTION OF THE INVENTION

DETAILED DESCRIPTION OF THE PREFERRED EMBODIMENTS

Figure 5:
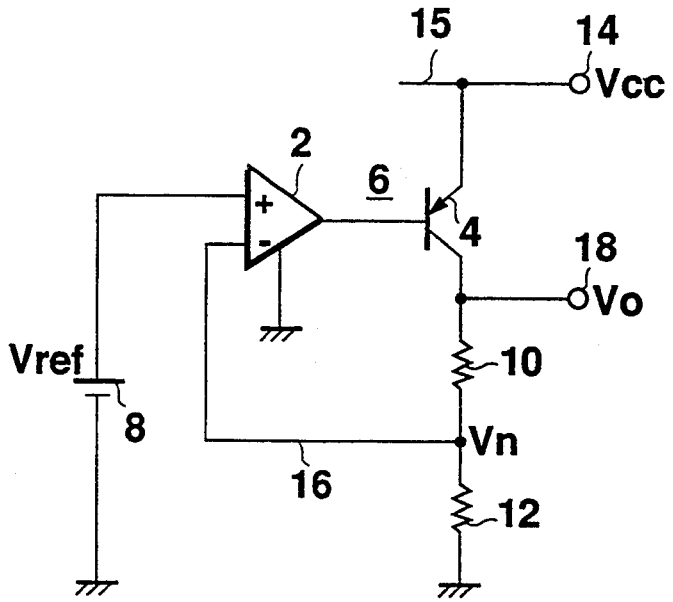
Fig. 5 PRIOR ART
FIG. 5 is a circuit diagram illustrating the principle of the power circuit.
Figure 6:
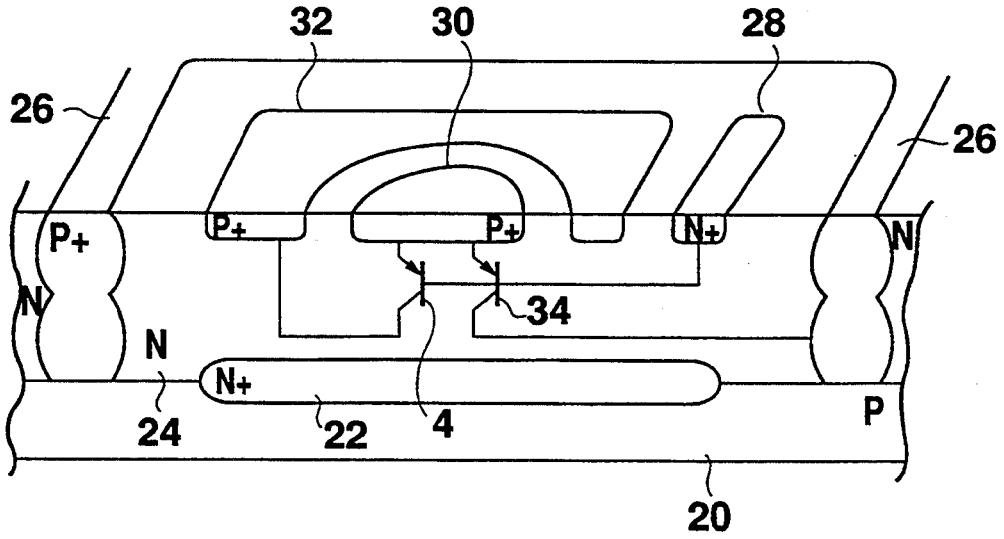
Fig. 6 PRIOR ART
FIG. 6 is a view illustrating the production of a parasitic transistor in the power circuit of FIG. 5.
Figure 7:
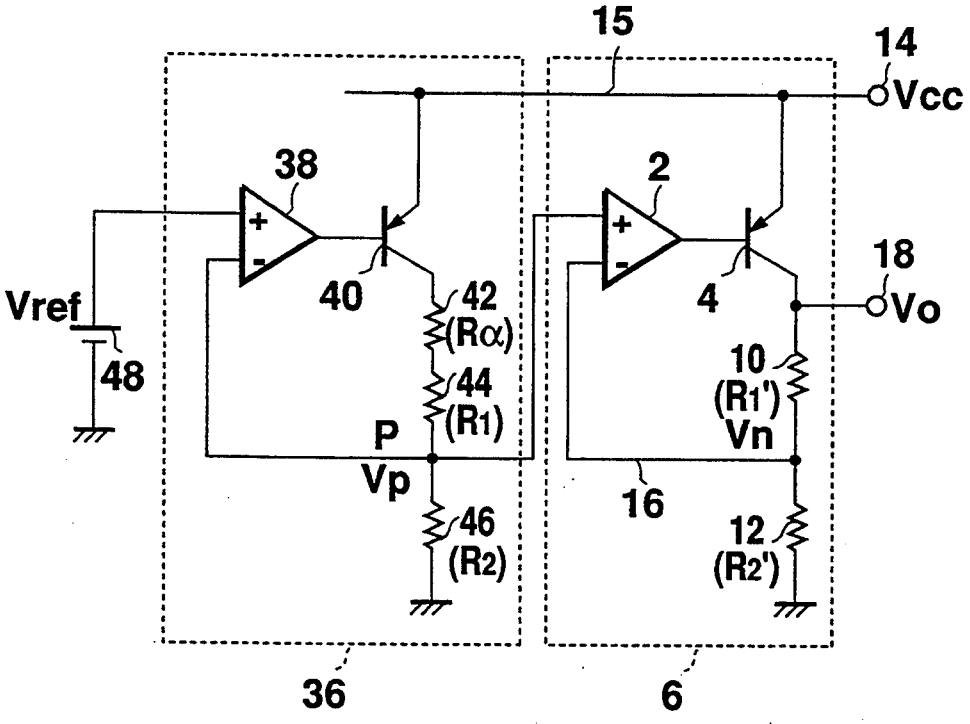
Fig. 7 PRIOR ART
FIG. 7 is a circuit diagram showing a power circuit to which a saturation preventing circuit is added.

The present invention will now be described by way of example with reference to the drawings, in which parts similar to those of FIGS. 5–7 are designated by similar reference numerals.

Figure 1:
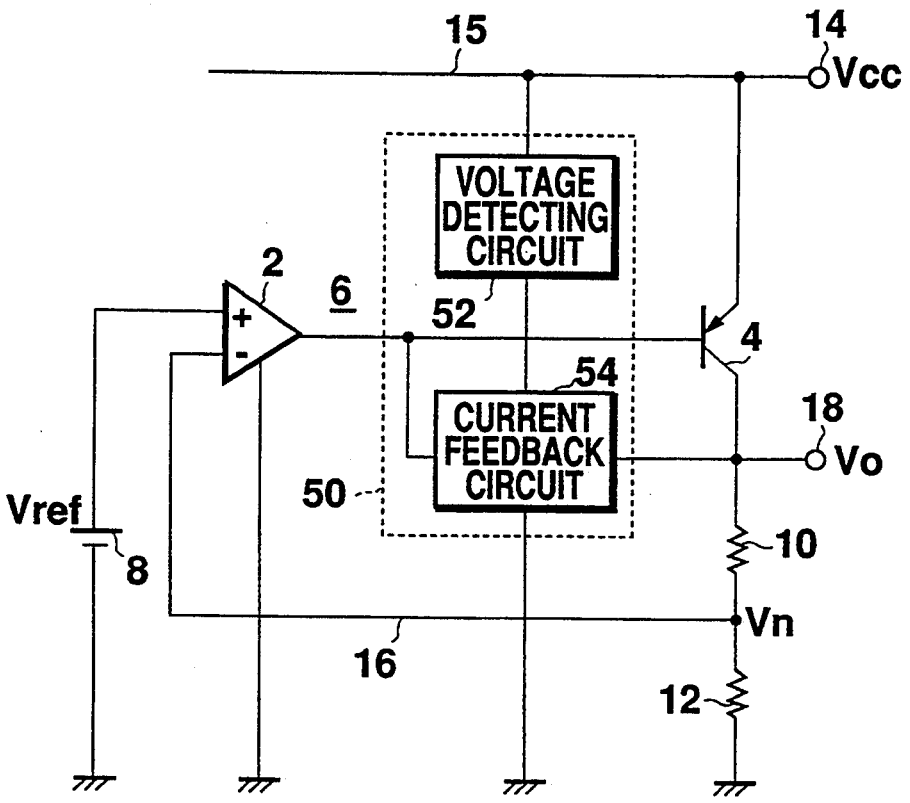
FIG. 1 is a circuit diagram showing one embodiment of a power supply constructed in accordance with the present invention.

Referring to FIG. 1, there is shown one embodiment of a power supply constructed in accordance with the present invention. The power supply comprises a stabilizing circuit 6 having a differential amplifier 2 and an output transistor 4, as in the power circuit shown in FIG. 5. A voltage source 8 is connected between the noninverting input terminal of the output transistor 4 and a grounding point so that the noninverting input terminal receives a reference voltage $V_{ref}$. The collector of the output transistor 4 is connected in series to resistors 10 and 12 which function as a load resistor in the output transistor 4 and also as a voltage dividing circuit for detecting an output. The series circuit consisting of the output transistor 4 and resistors 10 and 12 is connected in series between a power line 15 coupled with a power voltage $V_{cc}$ through a power terminal 14 and a grounding point. The dividing point between the resistors 10 and 12 provides a voltage $V_n$ which is applied to the inverting input terminal of the differential amplifier 2 through a feedback line 16.

The power supply also comprises a saturation preventing circuit 50 for preventing the output transistor 4 from transferring to its saturated state. The saturation preventing circuit 50 comprises a voltage detecting circuit 52 for detecting any reduction in the power voltage $V_{cc}$ and a current feedback circuit 54 responsive to the detection of voltage reduction for taking the current flowing in the output transistor 4 and for feeding the current back to the base input of the output transistor 4 to suppress the base current of the output transistor 4.

The voltage detecting circuit 52 detects the reduction of the power voltage $V_{cc}$ through the power line 15 to form an output current representing that voltage reduction. This output current is inputted to the current feedback circuit 54 as a detection output. The current feedback circuit 54 is responsive to the current from the voltage detecting circuit 52 for taking the current from the collector of the output transistor 4 and for feeding that current back to the base of the output transistor 4. Thus, the current feedback circuit 54 will suppress the base current of the output transistor 4. As a result, the base current of the output transistor 4 will be controlled or suppressed depending on the reduction of power so that the output transistor 4 can be rapidly and effectively prevented from transferring to its saturated state.

Such a procedure that the output transistor 4 is prevented from being saturated on power reduction will not impair the stabilization at all. This is because in both the steady and power-reduction states, the differential amplifier 2 compares the reference voltage $V_{ref}$ with the voltage $V_n$ detected at the voltage dividing point between the resistors 10 and 12, the resulting difference producing the base current of the output transistor 4. The current in the output transistor 4 is thus controlled depending on the differential voltage. Based on the current control of the output transistor 4, the output terminal 18 will take in the output voltage $V_0$ as a stabilized output.

Figure 2:
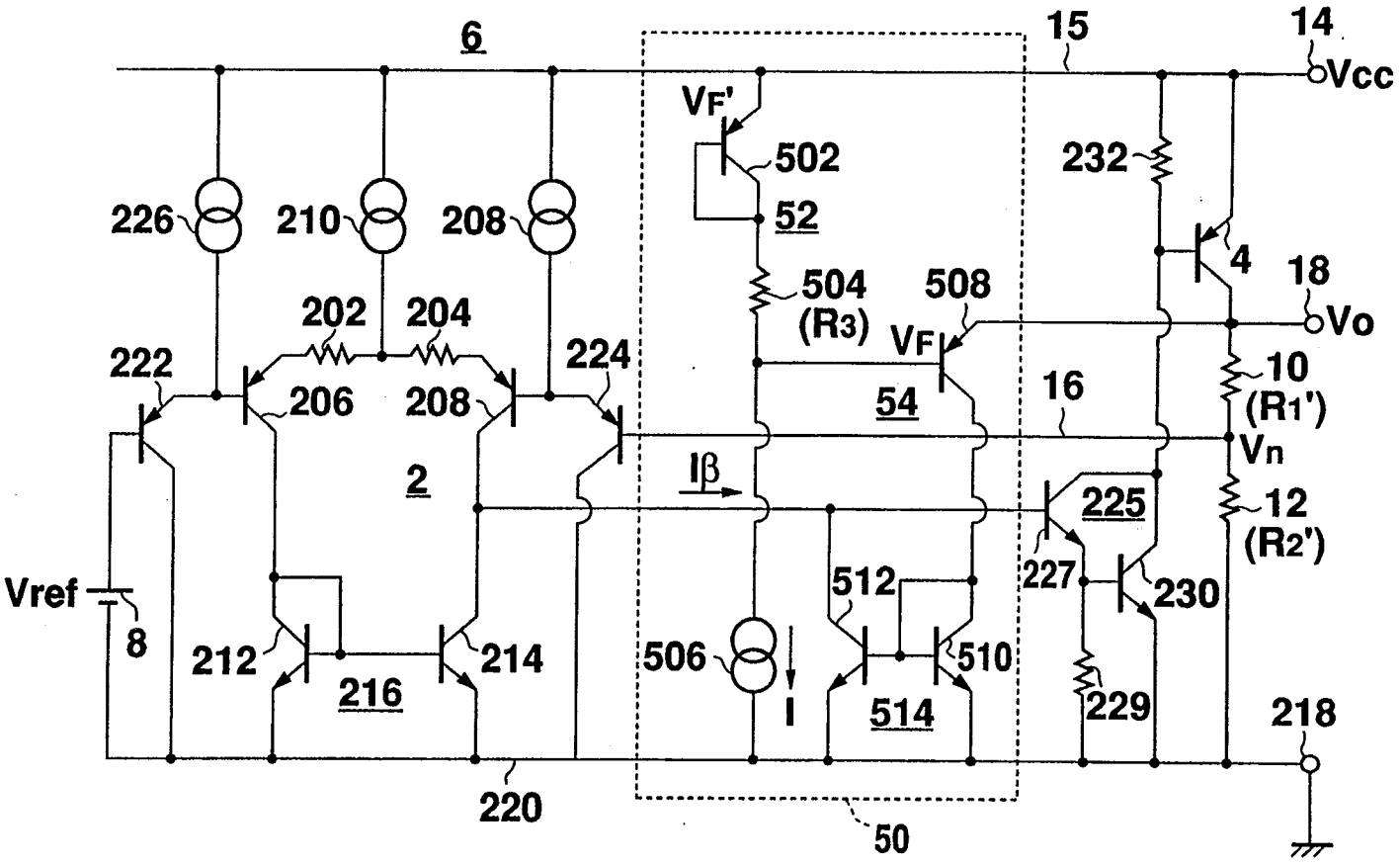
FIG. 2 is a circuit diagram showing a power supply of the present invention in more detail.

Referring now to FIG. 2, there is shown a differential amplifier 2 which defines means for comparing the reference voltage $V_{ref}$ with the feedback voltage $V_n$. The differential amplifier 2 comprises transistors 206, 208 having a common emitter respectively formed through resistors 202, 204; a constant current source 210 for providing an actuating current to the transistors 206, 208; and an active load (current mirror circuit) 216 consisting of transistors 212, 214 which are located on the collector sides of the transistors 206 and 208, respectively. In FIG. 2, reference numeral 218 denotes a grounding terminal and 220 designates a grounding line.

The base of each of the transistors 206 and 208 is connected to a level shifting transistor 222 or 224. The emitter of each of the transistors 222 and 224 receives a constant current from the corresponding one of the constant current sources 226 and 228. The base of the transistor 222 is the noninverting input terminal of the differential amplifier 2 while the base of the transistor 224 is the inverting input terminal of the differential amplifier 2. More particularly, the base of the transistor 222 is connected to a voltage source 8 while the base of the transistor 224 is connected to a feedback line 16.

The output of the differential amplifier 2 is taken out of the collector of the transistor 208 and then applied to an output circuit 225. More particularly, the output taken out from the collector of the transistor 208 is applied to the base of a transistor 227. The transistor 227 produces an emitter output depending on its base input, the emitter output being then applied to the base of a transistor 230 as the voltage of a resistor 229. Since the transistors 227 and 230 are coupled with each other as a Darlington amplifier, the base current applied to the transistor 227 is amplified and fed into the transistor 230. Thus, the collector current of the transistor 230 becomes the base current of the output transistor 4. A resistor 232 is connected between the base and emitter of the output transistor 4 and forms a load resistor for the transistor 230 while defining a source of bias for the output transistor 4. The output transistor 4 amplifies the base current supplied thereto in such a manner. The collector current of the output transistor 4 flows through the resistors 10 and 12 forming the load resistor. As a result, the output voltage $V_0$ is produced as a stabilized output while a feedback voltage $V_n$ is generated.

The power supply further comprises a saturation preventing circuit 50 for preventing the output transistor 4 from being saturated when the power voltage $V_{cc}$ is reduced. More particularly, a diode-connected transistor 502, resistor 504 and constant current source 506 are connected in series between a power line 15 and a grounding line 220 to form a series circuit. The series circuit defines a voltage detecting circuit 52. A current feedback circuit 54 includes a transistor 508 for dividing the collector current of the output transistor 4. The base of the transistor 508 is connected to a connection between the resistor 504 and the constant current source 506. The collector current of the transistor 508 is fed back to the base input circuit of the output transistor 4, that is, the base input line of the transistor 227 through a current mirror circuit 514 which comprises transistors 510 and 512. Thus, the current flowing in the transistor 208 can be discharged to the side of the grounding line 220 through the current mirror circuit 514. In such a manner, the current feedback circuit 54 will be defined by the transistor 508 and the current mirror circuit 514.

When the power voltage $V_{cc}$ is maintained at a given voltage, the transistor 502 and resistor 504 produce a voltage drop due to a constant current I which is generated by the constant current source 506. In the steady state, thus, the transistor 508 is held at its cut-off state. From the stabilization by the differential amplifier 2 and output transistor 4, the output terminal 18 obtains the output voltage $V_0$ as a stabilized output. The output voltage $V_0$ in the steady state is:

$$V_0 = V_{ref}/R_2' \times (R_1' + R_2') \quad (2).$$

This provides the same stabilization as in the power circuit of FIG. 5.

When the power voltage $V_{cc}$ decreases to increase the voltage drop in the resistor 504 and to place the transistor 508 in its conducting state, the current in the output transistor 4 is taken into the transistor 510 of the current mirror circuit 514 through the transistor 508. The transistor 512 receives the same current as that of the transistor 510, by the current mirror effect. Part of the base current $I\beta$ to be fed to the base of the transistor 227 is taken into the transistor 512 and discharged to the grounding point through the grounding line 220.

When the transistor 508 is in its ON state, the following equation is established:

$$V_{cc} = V_0 - V_F + I \times R_3 + V_F' \quad (3)$$

where $R_3$ is a resistance in the resistor 504; $V_F$ a threshold voltage between the base and emitter of the transistor 508; $V_F'$ a threshold voltage between the base and emitter of the transistor 502; and I a constant current passing through the constant current source 506.

If $V_F = V_F'$, the equation (3) can be rewritten:

$$V_{cc} = V_0 + I \times R_3 \quad (4).$$

The output voltage $V_0$ becomes:

$$V_0 = V_{cc} + I \times R_3 \quad (5).$$

It is thus understood from these equations that the output voltage $V_0$ can be set by the resistance $R_3$ in the resistor 504.

When the current mirror circuit 514 takes the current, it increases the base current $I\beta$ of the transistor 227 supplied thereto from the collector of the transistor 208 such that the drive current of the output transistor 4 will be increased. However, the current feedback circuit 54, which is defined by the transistors 508, 510 and 512, converges the base current $I\beta$ to a proper level that will not saturate the output transistor 4. Therefore, the control system can be stabilized. In such a manner, the saturation preventing circuit 50 can prevent the output transistor from being saturated on power reduction to provide a stabilized output without impairing the stabilization.

Figure 3:
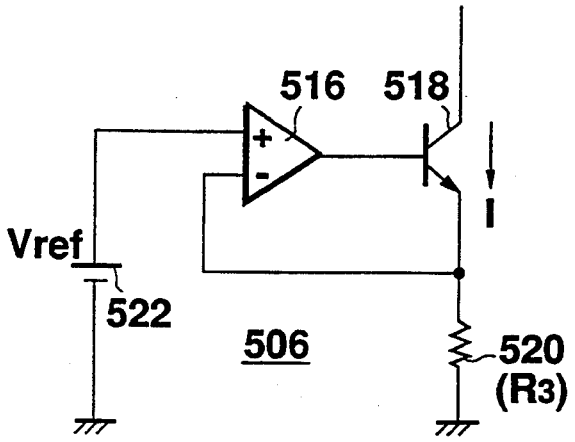
FIG. 3 is a circuit diagram showing a source of constant current in the power circuit of FIG. 1 in detail.
Figure 4:
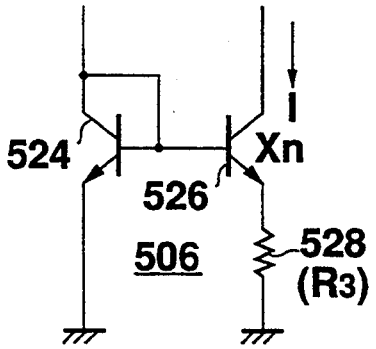
FIG. 4 is a circuit diagram showing another source of constant current in the power circuit of FIG. 1 in detail.

FIGS. 3 and 4 illustrate the details of the constant current source 506 in the power supply shown in FIG. 2. The constant current source 506 in FIG. 3 comprises a transistor 518 with the base being connected to the output side of a differential amplifier 516 and a resistor 520 connected to the emitter of the transistor 518. The noninverting input terminal of the differential amplifier 516 receives a reference voltage $V_{ref}$ from a source of voltage 522. A voltage produced at the resistor 522 is fed back to the inverting input terminal of the differential amplifier 516. When the resistor 520 is set to have the same resistance $R_3$ as that of the resistor 504, one can take a constant current I which is determined by the resistance $R_3$ and a reference voltage $V_{ref}'$. Even if such a constant current circuit is used in the constant current source 506 in the power circuit of FIG. 2, advantages similar to those of the previously described embodiments can be provided with a difference between input and output which is kept constant.

As shown in FIG. 4, the constant current source 506 may be a current mirror circuit comprising transistors 524, 526 and a resistor 528 connected to the emitter of the transistor 526, all of which are coupled with each other in the diode connection. The transistor 524 receives an external constant current. In such a case, if the current capacity of the transistor 526 is n times larger than that of the transistor 524 ($n>1$) and the resistance of the resistor 528 is equal to the resistance $R_3$ of the resistor 504, the same advantages as those of the previously described embodiments can be provided with a difference between input and output which is kept constant.

As will be apparent from the foregoing, the present invention provides the following advantages:

a. By controlling the base input current in the output transistor depending on the power reduction, the output transistor can be reliably prevented from being saturated without impairing the stabilization. This also prevents the occurrence of any rush current.

b. In comparison with the case where an additional circuit is provided to prevent the saturation in the output transistor, the present invention can simplify the stabilizing circuit and thus the entire circuit arrangement. At the same time, the output transistor as well as any circuit located upstream of the output transistor can be prevented from being shifted to their saturated state to improve the reliability in operation.

What is claimed is:

1. A stabilized voltage supply comprising:

an output element for outputting an output current depending on a current supplied to said output element, said output element being responsive to a power voltage;

current/voltage converting means for converting the output current of said output element into a voltage which in turn is outputted therefrom as a stabilized output voltage;

means for comparing said stabilized output voltage directly or indirectly with a predetermined reference voltage, said comparing means being responsive to the result from the comparison to provide a current to said output element; and means for adjusting the current supplied to said output element such that said output element will not be saturated when the power voltage decreases to a level equal to or lower than a predetermined level, including means for detecting a drop in the power voltage;

current dividing means for dividing part of the output current of said output element when the power voltage decreases to a level equal to or lower than the predetermined level; and means for subtracting a current corresponding to the divided current from the current supplied to said output element.

2. A stabilized voltage supply as defined in claim 1 wherein said output element comprises a transistor.

3. A stabilized voltage supply as defined in claim 1 wherein said current/voltage converting means includes a resistor through which the output current of said output element passes.

4. A stabilized voltage supply as defined in claim 1 wherein said current/voltage converting means includes a plurality of resistors connected in series with each other to pass the output current from said output element and wherein said comparing means is adapted to compare a potential at the connection between said resistors with said reference voltage.

5. A stabilized voltage supply as defined in claim 1 wherein said comparing means comprises a differential amplifier for receiving the stabilized output voltage indirectly and said reference voltage, said differential amplifier being adapted to compare these input voltages to form a differential voltage to be outputted from said differential amplifier.

6. A stabilized voltage supply as defined in claim 1, further comprising a battery for generating said reference voltage.

7. A stabilized voltage supply as defined in claim 1 wherein said current dividing means comprises a transistor which is shifted to its conducting state to take part of the output current from said output element when the power voltage decreases to a level equal to or lower than the predetermined level.

8. A stabilized voltage supply as defined in claim 7 wherein said power voltage drop detecting means includes a voltage drop detecting resistor for detecting the drop of the power voltage as a voltage drop across said voltage drop detecting resistor itself.

9. A stabilized voltage supply as defined in claim 8 wherein said power voltage drop detecting means includes a constant current source adapted to supply a constant current to said voltage drop detecting resistor, whereby the output voltage of said output element produced when the power voltage decreases to a level equal to or lower than the predetermined level can be set by the voltage drop in said voltage drop detecting resistor.

10. A stabilized voltage supply as defined in claim 9 wherein said constant current source comprises:

a voltage feedback resistor having the same resistance as that of said voltage drop detecting resistor and being connected in series to said voltage drop detecting resistor;

a differential amplifier for comparing a voltage between the opposite ends of said voltage feedback resistor with a predetermined value to form a differential voltage which in turn is outputted from said differential amplifier; and means responsive to the output voltage of said differential amplifier for controlling the current supplied to said voltage feedback resistor to provide a constant current.

11. A stabilized voltage supply as defined in claim 9 wherein said constant current source comprises:

a voltage feedback resistor having the same resistance as that of said voltage drop detecting resistor and being connected in series to said voltage drop detecting resistor; and a current mirror circuit including an input transistor and an output transistor, said input transistor receiving an external constant current, said output transistor having a current capacity larger than that of said input transistor and being adapted to provide a current to said voltage drop detecting resistor, said output transistor being further adapted to receive the voltage feedback from said voltage drop detecting resistor such that the current supplied to said voltage drop detecting resistor will be a constant current.

12. A stabilized voltage supply as defined in claim 1 wherein said subtracting means includes a current mirror circuit for dividing a current corresponding to the divided current from the current supplied from said comparing means to said output element.

13. A stabilized voltage supply comprising:

a semiconductor substrate;

an output transistor for outputting a current depending on a current in the control electrode of said output transistor, said output transistor being responsive to a power voltage, said semiconductor substrate being heated when said output transistor is saturated;

a voltage dividing resistor for converting the output current of said output transistor into a stabilized output voltage which in turn is divided to form a feedback voltage to be outputted therefrom;

a differential amplifier for amplifying a differential voltage between said feedback voltage and a predetermined reference voltage, said differential voltage being then applied to the control electrode of said output transistor; and a circuit for preventing the output transistor from being saturated, said circuit comprising: a voltage detecting circuit for detecting when the power voltage is lowered to a level equal to or lower than a predetermined level; and a current feedback circuit for dividing the output current of the output transistor to form a divided current when it is detected that the power voltage is lowered to a level equal to or lower than the predetermined level and for subtracting a current corresponding to said divided current from a current which is produced by the voltage of the output transistor and flows in the control electrode of the output transistor.

* * * * *